US008100418B2

(12) United States Patent
Watts

(10) Patent No.: US 8,100,418 B2
(45) Date of Patent: Jan. 24, 2012

(54) FOLDING SEAT

(75) Inventor: Steven Watts, London (GB)

(73) Assignee: Rotasol International Ltd. (GB)

( * ) Notice: Subject to any disclaimer, the term of this patent is extended or adjusted under 35 U.S.C. 154(b) by 470 days.

(21) Appl. No.: 12/224,914

(22) PCT Filed: Mar. 6, 2007

(86) PCT No.: PCT/GB2007/000771

§ 371 (c)(1),
(2), (4) Date: Jan. 12, 2009

(87) PCT Pub. No.: WO2007/101987

PCT Pub. Date: Sep. 13, 2007

(65) Prior Publication Data

US 2009/0224496 A1 Sep. 10, 2009

(30) Foreign Application Priority Data

Mar. 6, 2006 (GB) ..... 0604435.8

(51) Int. Cl.
*B62B 7/00* (2006.01)

(52) U.S. Cl. ..... 280/47.38; 280/47.4

(58) Field of Classification Search ..... 280/30, 280/47.25, 47.33, 47.26, 47.23, 47.4, 47.41, 280/37, 47.38; 297/378.1, 217.2, 129, 184.15, 297/188.01, 344.26, 188.11, 380, 255, 378.12
See application file for complete search history.

(56) References Cited

U.S. PATENT DOCUMENTS

| | | | | |
|---|---|---|---|---|
| 3,179,465 | A * | 4/1965 | Roberts | 297/183.5 |
| 3,594,039 | A * | 7/1971 | Harp | 297/188.1 |
| 3,646,896 | A | 3/1972 | Derujinsky et al. | |
| 4,079,992 | A * | 3/1978 | Thrift et al. | 297/183.5 |
| 4,871,209 | A * | 10/1989 | Handelman | 297/378.1 |
| 4,971,390 | A | 11/1990 | McGinley | |
| 5,069,504 | A | 12/1991 | Felling | |
| 5,100,198 | A | 3/1992 | Baltzell | |
| 5,176,422 | A * | 1/1993 | Canet | 297/118 |
| 5,299,337 | A * | 4/1994 | Venza | 297/184.15 |
| 5,395,157 | A * | 3/1995 | Rollo et al. | 297/344.26 |
| 5,421,637 | A * | 6/1995 | Lemburg | 297/188.01 |
| 5,580,125 | A * | 12/1996 | Alger | 297/250.1 |
| 5,582,458 | A * | 12/1996 | Wildt | 297/188.01 |
| 5,690,385 | A | 11/1997 | Feldman et al. | |
| 5,701,979 | A * | 12/1997 | Voich | 297/129 |
| 5,975,630 | A | 11/1999 | Schreiber | |
| 6,206,463 | B1 * | 3/2001 | Whigham | 297/129 |
| 6,264,216 | B1 * | 7/2001 | Wilson | 280/30 |
| 6,767,058 | B2 * | 7/2004 | McClellan-Derrickson | 297/255 |
| 6,848,746 | B2 * | 2/2005 | Gentry | 297/180.11 |
| 7,000,993 | B2 * | 2/2006 | Lee | 297/188.1 |

FOREIGN PATENT DOCUMENTS

DE 1 162 046 B 1/1964

(Continued)

*Primary Examiner* — Hau Phan
(74) *Attorney, Agent, or Firm* — Lerner, David, Littenberg, Krumbolz & Mentlik, LLP

(57) ABSTRACT

A folding seat comprising a base and a back hinged thereto, in which the base comprises an open topped container defining an inner storage space, in which in a first arrangement the back is folded onto the base, and a closed container is formed, and in which in a second arrangement the back is unfolded from the base and a seating or lying platform is formed.

22 Claims, 10 Drawing Sheets

FOREIGN PATENT DOCUMENTS

| | | | |
|---|---|---|---|
| DE | 1 914 131 | A | 10/1970 |
| DE | 196 49 951 | A1 | 6/1998 |
| DE | 103 31 140 | A1 | 1/2005 |
| FR | 2 797 571 | A1 | 2/2001 |
| GB | 2 428 234 | A | 1/2007 |
| WO | WO-99/18824 | A1 | 4/1999 |

* cited by examiner 1
2
31
32
12
36
6
24
23
11
9
15
16
3
13
11
9

1
2
3
4
5
8
9
9
9a
12
13
22
25
31
32
A
A 1
2
3
7
8
9
9
12
13
14
22
24
25
31
32

60
Rotaso
Rotaso
Rotaso
Rotaso 99
92
64
60
62
101
100

60
64
92
89
90
91
62
Rotaso

FOLDING SEAT

This invention relates to a folding seat, for use particularly, but not exclusively, in public holidaying spots.

Wherever the sun shines, people sunbathe, and when people sunbathe they often use a sun lounger. Such items usually have an adjustable back, which can be rotated into various reclined positions. A sun lounger often forms the centre of personal activity pool side or on a beach. A user's towel is usually draped over the lounger, and their belongings and clothes are placed under or next to it.

However, the sun has an annoying habit of moving through the sky during the day, and in order to catch the most rays, the user of a sun lounger has to move it. While some sun loungers are provided with one or more pair of wheels, these are not ideal for simply rotating the lounger.

In addition, sun loungers are usually rather rigid in construction, and can be somewhat uncomfortable without a cushion or towel.

Visitors to the beach or other pleasant spots will often arrive with a number of personal items, including their towel, change of clothes and other personal effects and belongings. However, these items are left unattended whenever the owner goes for a swim, or to get something to drink. As a result, theft is a simple, and relatively widespread occurrence in such circumstances.

The present invention is intended to overcome some of the above problems.

Therefore, according to the present invention a folding seat comprises a base and a back hinged thereto, in which the base comprises an open topped container defining an inner storage space, in which in a first arrangement the back is folded onto the base, and a closed container is formed and in which in a second arrangement the back is unfolded from the base and a seating or lying platform is formed.

Thus, the invention provides a sun lounger which can be folded up into a closable container when it is left unattended. With this arrangement a user can leave their belonging with their lounger in safety.

The back can be arranged in a number of rotational positions in relation to the base, so a number of increasingly more reclined seating platforms can be arranged, as well as a completely flat lying platform. The "second arrangement" of the invention includes all of these different positions.

In a preferred construction a seat base can be provided by the base, which seat base can form the seat part of the seating or lying platform.

The back can be connected to the base by hinge means, and it can have an outer end and an inner end. Preferably the axis of rotation of the hinge means can be spaced apart from the inner end, and a first end of the seat base can be hinged to the inner end of the back. Thus, when the back is rotated from a folded to an unfolded position, its inner end follows a circumferential path around the axis of rotation of the hinge means. This path moves the inner end of the back from a point adjacent a rear of the base, down into the base, then up towards the open top of the base. As the seat base is attached to the inner end of the back, the seat base is therefore moved at the same time from a stored position towards the rear of the base, to a raised central position.

The seat base can have a second end opposite to the first end, and preferably the base can be adapted to position the second end level with or above the first end when the seating or lying platform is formed. Thus, the seat base will never be inclined downwardly and away from the seat back.

In a preferred construction the base can be provided with interior side walls, which can be provided with guide channels. The seat base can be provided with guide pins located in said guide channels, and the guide channels can follow an inclined path, such that the second end of the seat base is level with or above the first end when the seating or lying platform is formed, as described above. Therefore, when the folding seat is arranged as a seat with a back, it forms a "bucket" seat, which becomes less so the more back is rotated away from the base, until a lying platform is formed.

The hinge means can be provided with locking means adapted to lock the back in one or more seating or lying positions. Thus, the user can position the back at a desired angle and lock it there. Such locking arrangements are well known.

In a first version of the invention the guide channels can be smooth, such that the guide pins can move freely through them. In this construction the back can be provided with a rear surface, and the base can be provided with an exterior surface, and the rear surface of the back can contact the exterior surface of the base when the back is substantially horizontal. Thus, the base can support the back in a flat position and prevent it from over rotating.

In an alternative version of the invention the guide channels can be provided with indents adapted to receive the guide pins when the back is locked in particular positions. This arrangement prevents the weight of the user being supported only by the locking means. In this version of the invention the back can be locked at substantially 107 degrees to the base, at substantially 135 degrees to the base and at substantially 163 degrees to the base. In addition, the base can be provided with support means, and the second end of the seat base can be supported by said support means when the back is arranged at one or more of the above described angles to the base. Again, this spreads the loading placed on the seat in use.

In either of the above described versions of the invention an extension part can be hinged to the second end of the seat base, which extension part can be manually unfoldable from the seat base. This extension part is essentially a foot rest.

The base can be provided with a drain. Thus, if any water enters the base in use, it will drain out and the base will not fill with water. The interior side walls of the base can also be provided with storage compartments.

The base can have an upper surface adjacent to the inner storage space, and in one version of the invention this upper surface can be provided with storage compartments.

In one embodiment of the invention the base can comprise a stationary part and a rotating part, in which the rotating part can comprise the back and seat base. Thus, the seating platform or lying platform can be readily rotated to face the sun. (The stationary part is referred to as "stationary" because it remains in a fixed position on the ground when the rotating part is rotated. Obviously the whole base can be moved as one if desired.)

An annular bearing means can be disposed between the stationary part and the rotating part. In one version of the invention this bearing means can comprise a race on the stationary part, a race on the rotating part, and balls disposed in said races. Preferably the balls can be resilient. With this arrangement the balls not only provide the rotational movement, but act to spring the rotating part in relation to the stationary part. This provides an added degree of comfort.

In an alternative construction the annular bearing means can comprise an inner bearing and an outer bearing both of which can comprise an annular arrangement of rollers provided on the stationary part and runner surfaces provided on the rotating part. This is a more robust construction than that described above.

The folding seat can be provided with a releasable latch means adapted to prevent the rotating part rotating in relation to the stationary part. This feature can be used to stop the seat from rotating when desired.

In a preferred construction the underside of the folding seat can be provided with a concavity, and a top side of the folding seat can be provided with a convexity adapted to fit into the concavity. With this arrangement the folding seat can be stackable with other folding seats of the same construction.

The base can be provided with wheels, which can be arranged at a first end thereof, and the base can also be provided with a handle at a second end thereof. Such a construction allows for each transportation of the folding seat.

A lock can be provided to lock the closed container. Any known type of container lock can be used.

The invention can be performed in various ways, but two embodiments will now be described by way of example and with reference to the accompanying drawings, in which.

Figure 1:
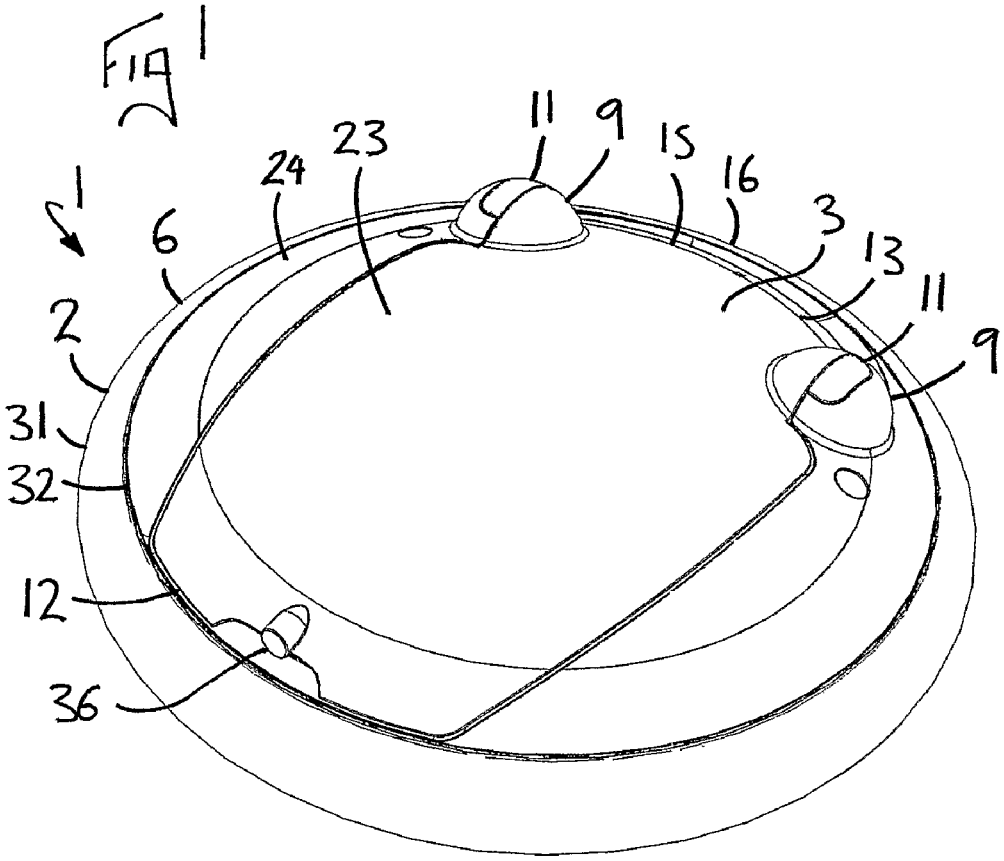
FIG. 1 is a perspective view of a folding seat according to the invention shown in a first arrangement.

As shown in FIGS. 1 to 5 a folding seat 1 comprises a base, generally designated 2, and a back 3 hinged thereto. The base 2 comprises an open topped container 4 defining an inner storage space 5. In a first arrangement as shown in FIG. 1 the back 3 is folded onto the base 2, and a closed container 6 is formed, and in a second arrangement shown in FIG. 4 the back 3 is unfolded from the base 2 and a seating platform 7 is formed.

A seat base 8 is fitted in the container 4, which forms the seat part of the seating platform 7.

Figure 2:
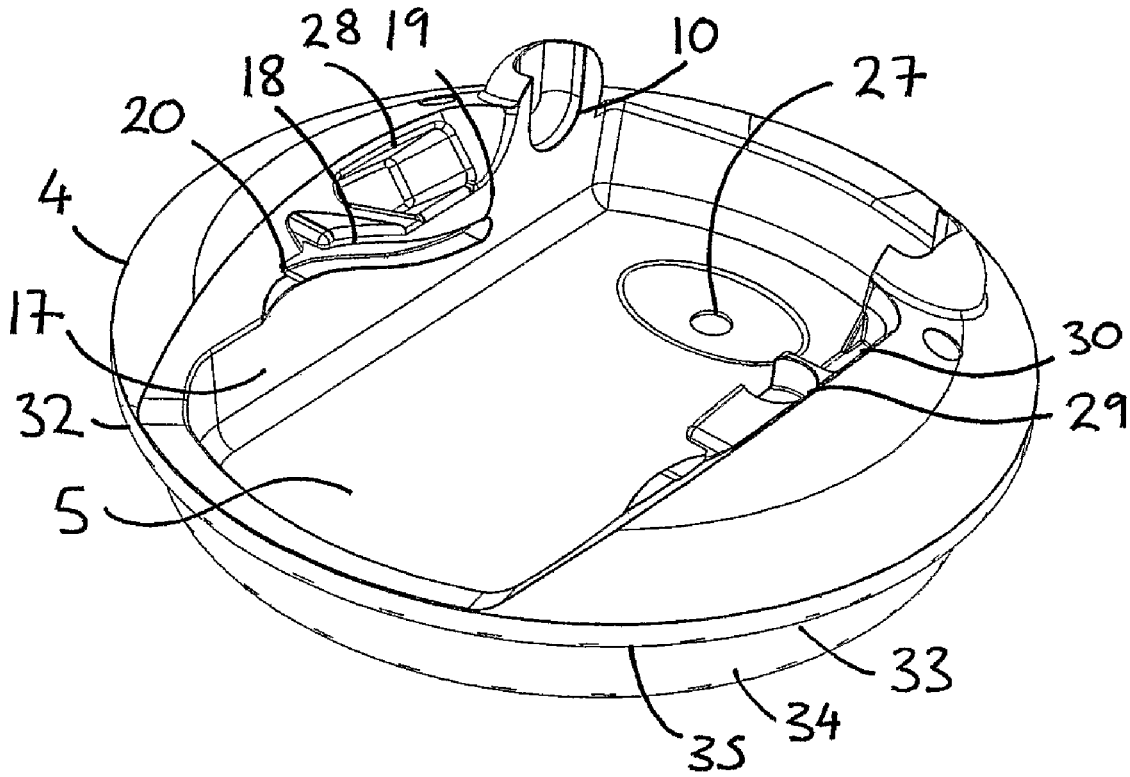
FIG. 2 is a perspective view of one component of the folding seat as shown in FIG. 1.

The back 3 is connected to the container 4 by a first hinge means 9, which are formed by pins (not visible) on the back 3 which are fitted into sockets 10 provided on the container 4, as is clear from FIG. 2. Assembly plugs 11 are fitted over the pins in the sockets 10 to hold the pins therein.

Figure 3:
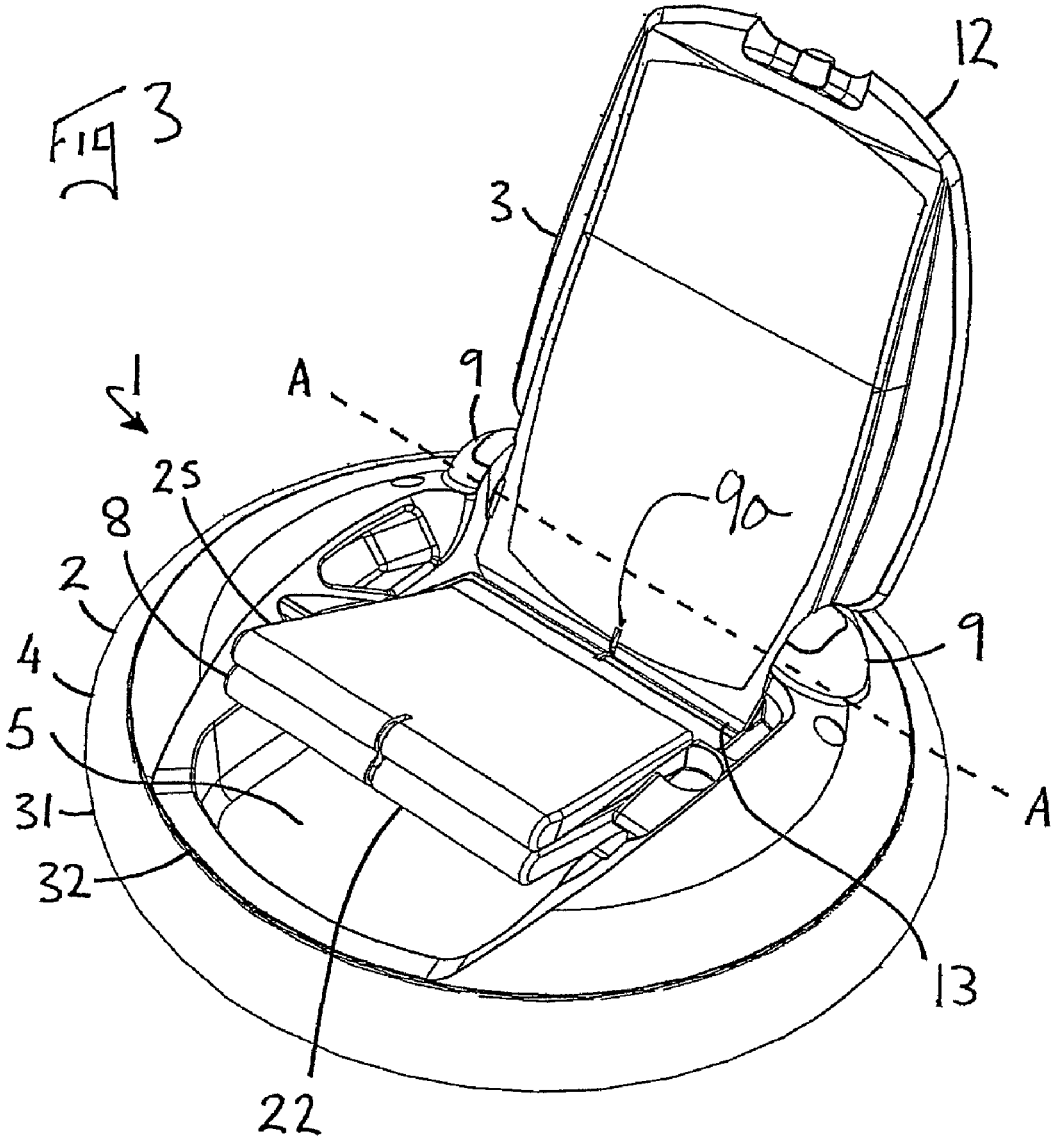
FIG. 3 is a perspective view of the folding seat shown in FIG. 1 shown between a first and a second arrangement.

The back 3 has an outer end 12 and an inner end 13, and as is clear from FIG. 3 the axis of rotation of the first hinge means 9, which is shown by hashed line A-A, is spaced apart from the inner end 13. A first end 14 of the seat base 8 is hinged to the inner end 13 of the back 3 by a second hinge means 9*a*. Thus, when the back 3 is rotated from a folded to an unfolded position, its inner end 13 follows a circumferential path around the axis of rotation A-A of the first hinge means 9. This path moves the inner end 13 of the back 3 from a point 15 adjacent a rear 16 of the base 2, as shown in FIG. 1, down into the container 4, as shown in FIG. 3, then up towards the position shown in FIG. 4. As the seat base 8 is attached to inner end 13 of the back 3, the seat base 8 is therefore moved at the same time from a stored position towards the rear of the inner storage space 6, to a raised central position as shown in FIG. 4.

Referring to FIG. 2, the container 4 is provided with interior side walls 17, which have guide channels 18 formed in them. (Only one channel 18 is visible, but an identical channel is provided on the opposite side.) The guide channels 18 follow a curved inclined path which begins at a first end 19, and ends at a second end 20. The seat base 8 is provided with guide pins 21, which are most clearly visible in FIG. 5, situated approximately half way along its length, which locate in the guide channels 18, and which slide therethrough when the back 3 rotates.

Figure 5:
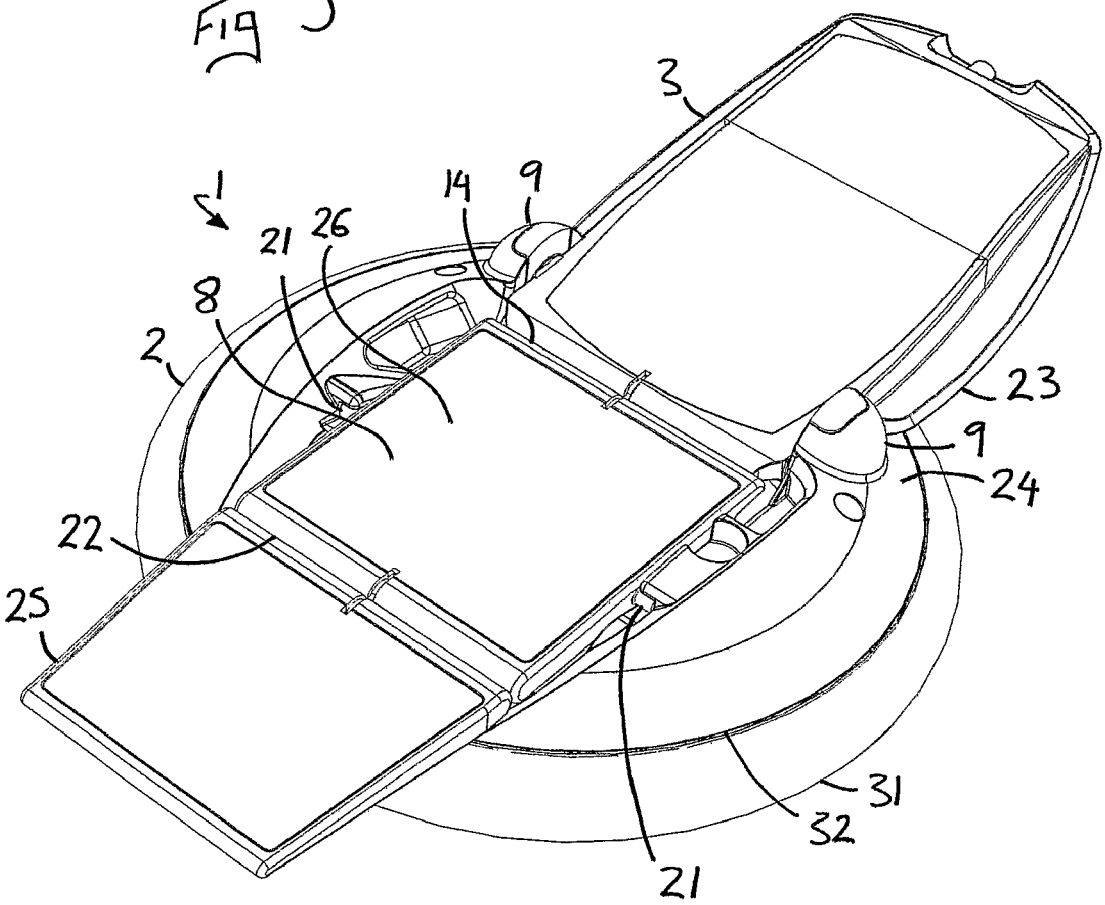
FIG. 5 is a perspective view of the folding seat shown in FIG. 1 in a further second arrangement.

The guide channels 18 are shaped and arranged such that the position of the guide pins 21 in relation to the inner end 13 of the back 3 at any rotational position of the back 3 between vertical and the fully unfolded position shown in FIG. 5, is such that a second end 22 of the seat base 8 is always above, or level with, the first end 14. This ensures that at any of these rotational positions of the back 3, a comfortable seating or lying platform is provided in which the seat base 8 is level with or angled down towards the back 3.

Figure 4:
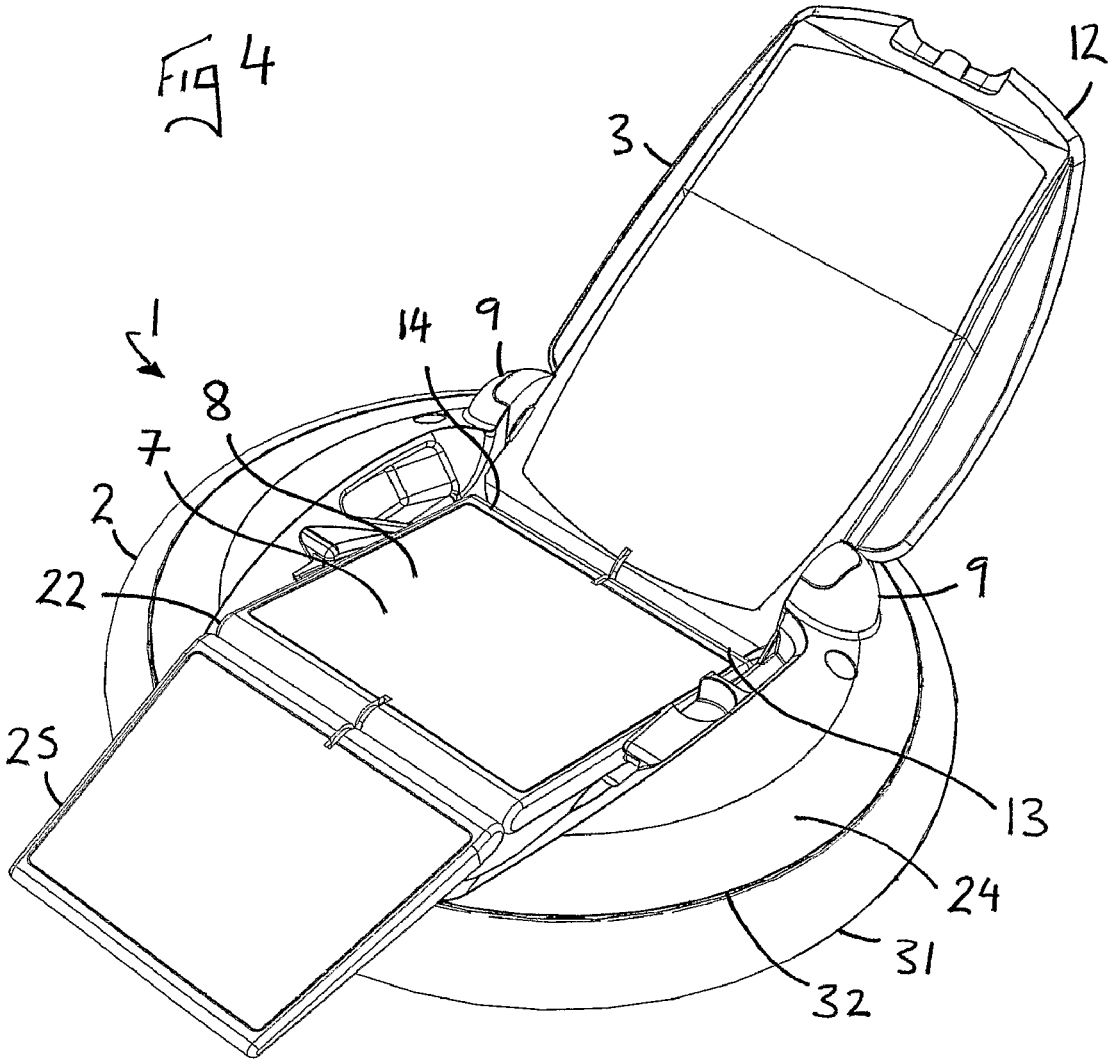
FIG. 4 is a perspective view of the folding seat shown in FIG. 1 in a second arrangement.

The first hinge means 9 are provided with known spring-loaded locking means adapted to lock the back 3 in a number of rotational positions, for example the relatively upright position shown in FIG. 3, and the relatively inclined position shown in FIG. 4. Such spring-loaded locking means are well known are not further described here.

The back 3 has a rear surface 23, and the base 2 has an exterior surface 24, and the rear surface 23 of the back 2 contacts the exterior surface 24 of the base 2 when the back 3 is substantially horizontal, as shown in FIG. 5. Thus, the base 2 supports the back 3 in the flat position and prevents it from over rotating beyond horizontal.

An extension part, in the form of footrest 25, is hinged to the second end 22 of the seat base 8. The footrest 25 is manually rotatable in relation to the seat base 8. As shown in FIG. 3, when the seat 1 is folded up the footrest 25 is folded over on top of the seat base 8. It is stored in that position with the seat base 8 towards the rear of the inner storage space 5 when the closed container 6 is formed as shown in FIG. 1. When the seat is unfolded as shown in FIGS. 4 and 5, the footrest 25 is unfolded from the seat base 8 and rests on the exterior surface 24 of the base 2.

As is clear from FIG. 4, as the seat base 8 is arranged with its outer end 22 above its inner end 14 by virtue of the above described construction, the outer end 22 is above the exterior surface 24. Thus, the footrest 25 depends downwards from the seat base 8 and a comfortable and ergonomic seating platform 7 is formed. When the seat base 8 is horizontal as shown in FIG. 5, the footrest 25 is also arranged horizontally on the exterior surface 24 and a flat lying platform 26 is formed The container 4 is provided with a drain 27, which is visible in FIG. 2. Thus, if any water enters the container 4 in use, it drains out and the container 4 does not fill with water. As is also clear from FIG. 2, the interior side walls 17 of the container 4 are provided with storage compartments. A first storage compartment 28 is formed on one side 17, while a cup holder 29 and a second storage compartment 30 are formed on the other side. As is clear from FIG. 1, these facilities are covered by the back 3 when the closed container 6 is formed.

The base 2 comprises a stationary part 31 and a rotating part 32. The rotating part 32 is shown in isolation in FIG. 2. The first hinge means 9 are provided on the rotating part 32, and thus the back 3, the seat base 8 and the footrest 25 all rotate with the rotating part 32.

A bearing means (not visible) is disposed between the stationary part 31 and the rotating part 32. A race (not visible) is provided on the stationary part 31, and a corresponding race 33 is provided on the rotating part 32. This "race" 33 basically comprises the visible side surface 34 and the underside of lip 35. A set of ball bearings (not visible) are disposed between said races. The balls are resilient, such that they not only provide rotational movement, but also act to spring the rotating part 32 in relation to the stationary part 31.

A lock 36 is provided between the back 3 and the base 2 to lock the closed container 6. This lock is of a known type.

Thus, in use the seat 1 can be used as a lockable container 6 as shown in FIG. 1, or as a seating platform 7 or lying platform 26 as shown in FIGS. 4 and 5.

If the seat 1 is to be used as a lockable container 6, the components of the seating platform 7 are folded up and the back 3 is rotated onto the base 2, and optionally locked thereto.

Referring to FIG. 3, the footrest 25 is first rotated onto the seat base 8, then the back 3 is rotated towards the base 2. During this process the inner storage space 5 becomes accessible. As shown in FIG. 4, when the seating platform 7 is arranged, it overlies the inner storage space 5 and prevents access. If the footrest 25 is rotated onto the seat base 8 from the position shown in FIG. 4, then a small gap appears in front of the seat base 8, allowing limited access to the inner storage space 5. However, when the back 3 is rotated forwards from the position shown in FIG. 4, the seat base 8 moves back towards a rear of the inner storage space 5, and a much large access gap appears, as is clear from FIG. 3. The further over the back 3 is rotated towards the base 2, the bigger the gap becomes, until the back 3 itself comes down onto the base 2 and seals the inner storage space 5.

Therefore, the user can place items in the inner storage space 5 during the folding up process. The inner storage space 5 is large enough for towels, a change of clothes and small bags.

In addition to the inner storage space 5, there are storage compartments 28 and 30. The user can place any items into these spaces and they will also be secured when the back 3 is locked to the base 2. The user could also place items in the cup holder 29 if desired, although anything proud of the top of the cup holder 29 will prevent the back 3 from fully closing.

In order to employ the seat 1 as a seating platform 7 or lying platform 26 the reverse of the above is performed. The back 3 and the base 2 are unlocked from one another, and the back 3 is rotated away from the base 2, and positioned at the desired inclination, for example those shown in FIG. 3, 4, or 5. It can be locked in those positions by the spring loaded locking means in the hinge means 9. The footrest 25 is then unfolded from the seat base 8. Once the seat 1 is arranged as desired, the user can sit on the seating platform 7 or lye the lying platform 26. A towel or cushions can be placed seating platform 7 or the lying platform 26 if desired. The resilient balls (not shown) provide a degree of suspension to make the experience more comfortable.

It will be appreciated that the inner storage space 5 is not readily accessible if a user is seated on the seat 1, so any items the user may wish to have to hand can be stored in the storage compartments 28 and 30. A drink can be placed in the drinks holder 29 if desired.

The user can rotate the rotating part 32 in relation to the stationary part 31 to rotationally position the seat 1 as desired, perhaps towards the sun.

If any water enters the container 4 in use, it drains therefrom via the drain 27.

It will be appreciated from the above that the "second arrangement" according to the invention comprises a number of different arrangements including any effective seating arrangement from having the back 3 vertical, to having it horizontal as shown in FIG. 5.

A second embodiment of the invention is shown in FIGS. 6 to 11. In these Figures folding seat 60 works in basically the same way as folding seat 1 described above, but folding seat 60 comprises a number of alternative features.

Figure 6:
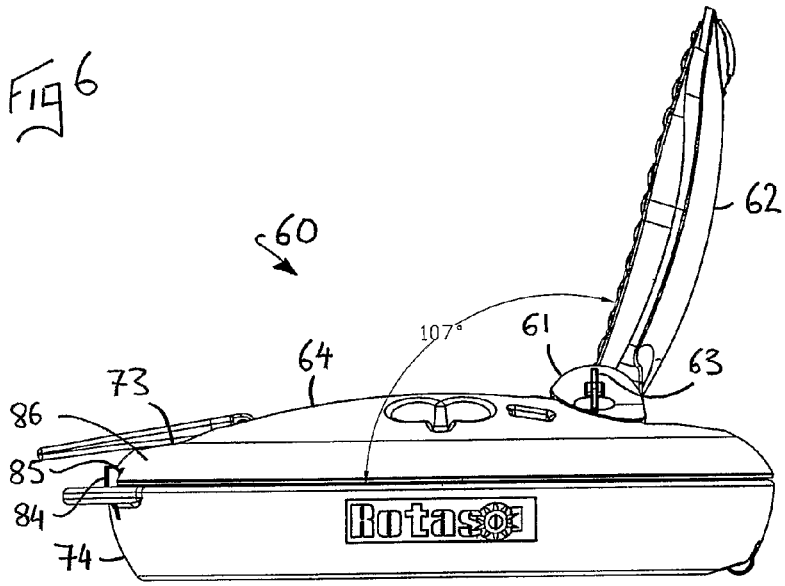
FIG. 6 is a side view of a second folding seat according to the invention shown in a second arrangement.
Figure 7:
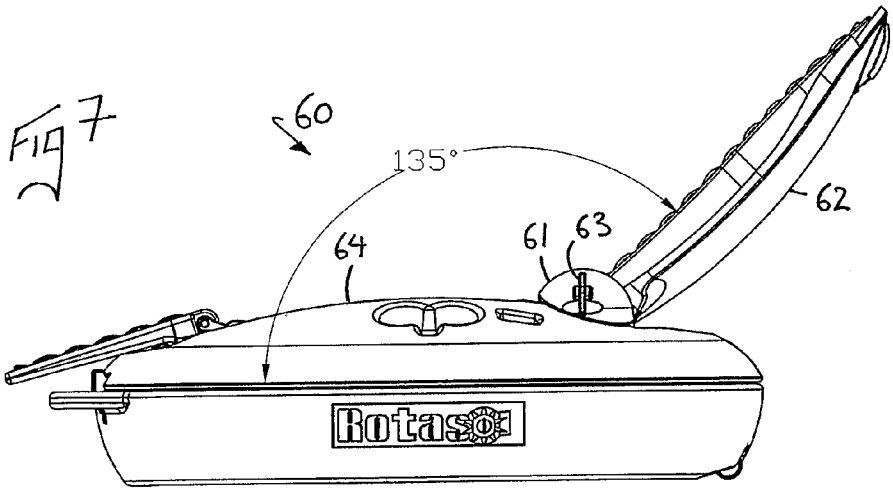
FIG. 7 is a side view of the second folding seat as shown in FIG. 6 in a further second arrangement.
Figure 8:
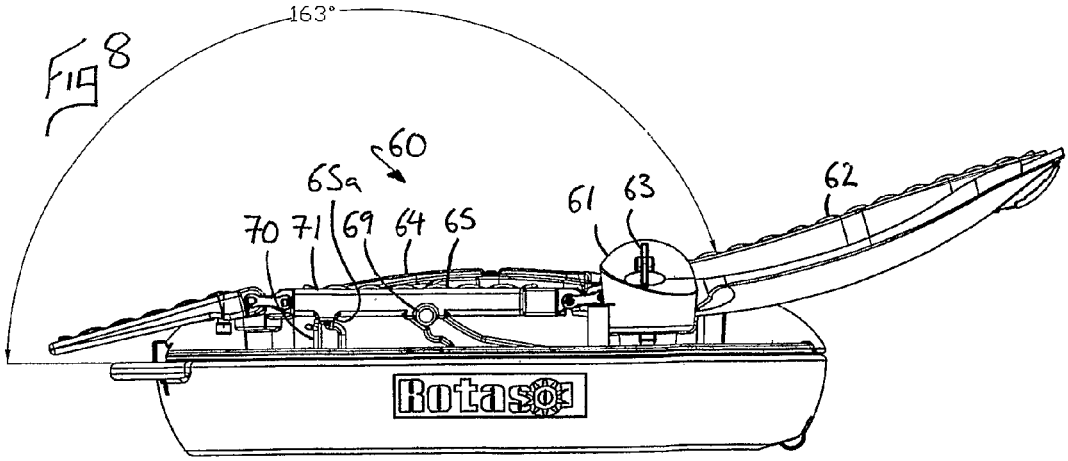
FIG. 8 is a side view of the second folding seat as shown in FIG. 6 in a further second arrangement.

In particular, folding seat 60 is adapted to be arranged in three specific second arrangements, as shown in FIGS. 6 to 8. The hinges 61 are provided with a spring-loaded ratchet system (not visible) of a known type, which can lock the back 62 in three specific positions. The hinges 61 are provided with release catches 63, operation of which releases the hinges 61 from a locked position and allows the back 62 to be rotated. The hinges 61 are adapted to lock the back 62 at 107 degrees to the base 64, at 135 degrees to the base 64 and at 163 degrees to the base 64.

In FIG. 8 the near side of a top part of the base 64 is not shown, so the seat base 65 is visible. It can be seen from FIG. 8 that the seat base 65 and the back 62 are configured such that the seat base 65 is horizontal when the back is arranged at 163 degrees to the base 64. Folding seat 60 does not recline into a completely horizontal lying platform like folding seat 1.

Figure 9:
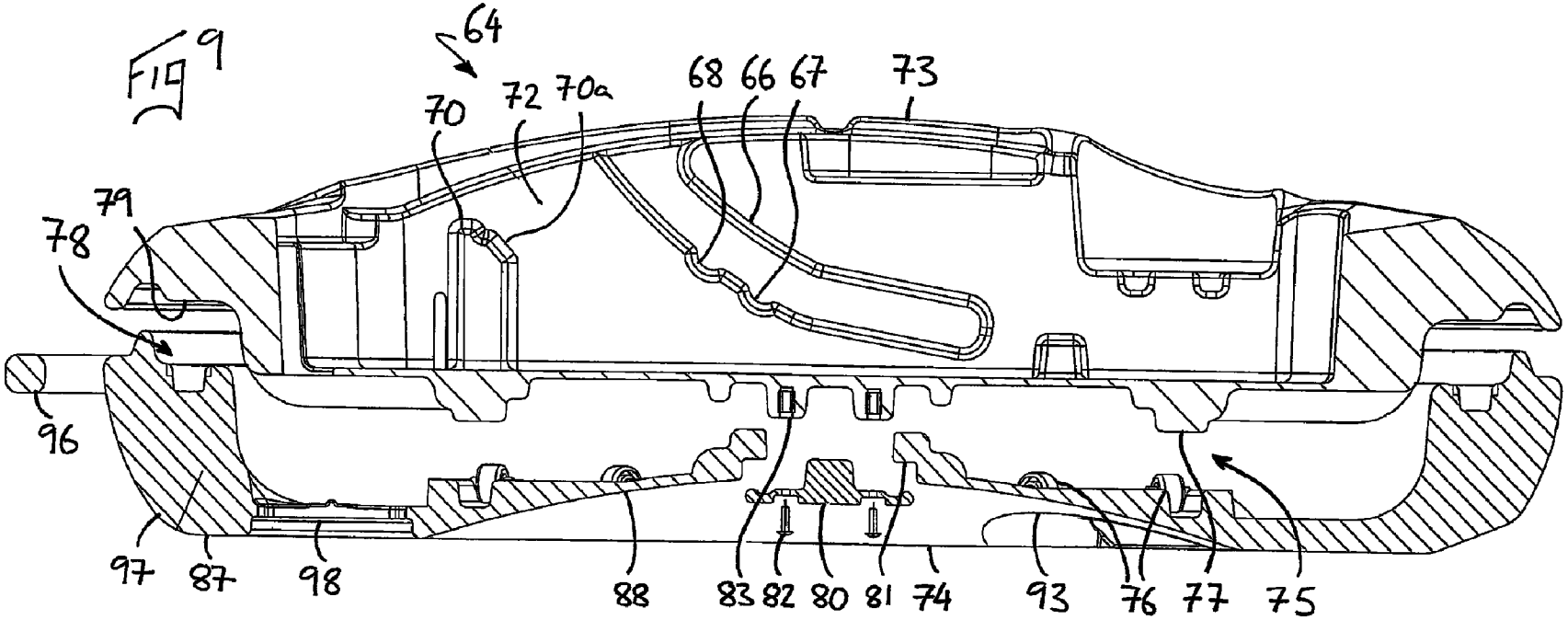
FIG. 9 is a cross-sectional view of the base component of the second folding seat shown in FIG. 6

Referring to FIG. 9, which is an exploded cross-sectional view of base 64, it can be seen that the guide channel 66 is provided with two indents 67 and 68. The indents 67 and 68 are specifically positioned such that the guide pins 69 provided on the seat base 65 are disposed therein in the first two second arrangements shown in FIGS. 6 and 7. This arrangement prevents the weight of a user being supported only by the hinges 61.

In addition, the base 64 is provided with upstanding support means 70, which support the second end 71 of the seat base 65 in the second arrangements, as is clear from FIG. 8. This spreads the load even more, and prevents undue stress being placed on any of the components. The support means 70 are abutments which extend from each of the opposing interior side walls 72. When the back 62 is locked at 107 degrees to the base 64, a boss **65*a* on the underside of the seat base 65 abuts against the support means 70. When the back 62 is locked at 135 degrees to the base 64, the boss 65*a* abuts against an inclined surface 70*a* on the support means 70, and when the back 62 is locked at 163 degrees to the base 64 the boss 65*a* sits on top of the support means 70**.

The base 64 comprises a rotating part 73 and a stationary part 74. An inner bearing 75 comprises an annular arrangement of rollers 76 on the stationary part 74 and a runner surface 77 on the rotating part 73. An outer bearing 78 also comprises an annular arrangement of rollers (not visible) on the stationary part 74 and a runner surface 79 on the rotating part 73. FIG. 9 is an exploded view of the components of the base 64, and it will be appreciated that the runner surfaces 77 and 79 contact the rollers when the base 64 is constructed. The rotating part 73 and the stationary part 74 are fixed together by plate 80, which abuts against under surface 81 on the stationary part 74, and is secured with screws 82 to downwardly depending bosses 83 provided on the rotating part 73.

Referring back to FIG. 6, the stationary part 74 is provided with a resilient latch 84, which can engage a slot 85 provided on an outer surface 86 of the rotating part 73. When the latch 84 is engaged in the slot 85 the rotating part 73 is prevented from rotating. The latch 84 can be manually released, allowing free rotation of the rotating part 73.

Figure 13:
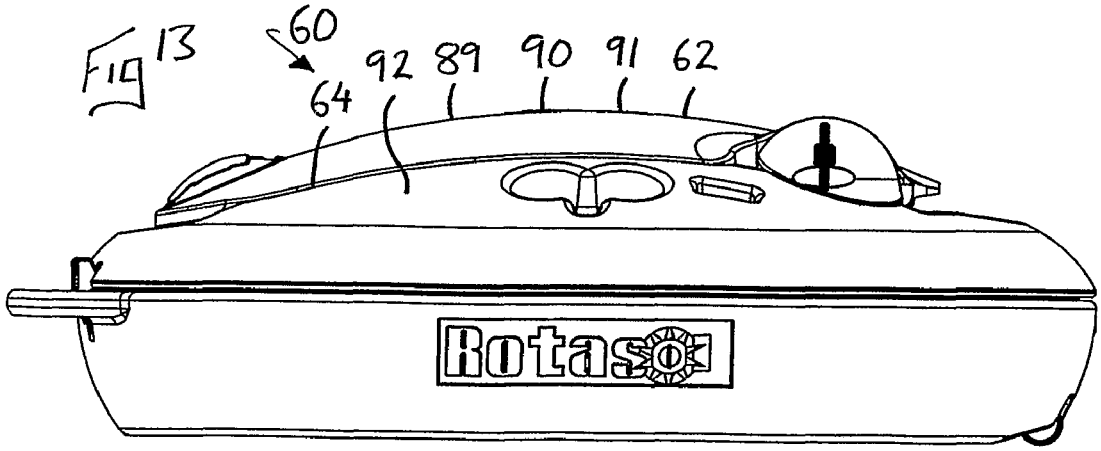

As shown in FIG. 9, the underside 87 of the stationary part 74 is provided with a concavity 88, and as is clear from FIG. 13 the top side 89 of the folding seat 60 is provided with a convexity 90, which is to say that it is convex in nature. This convexity 90 is formed by the rear surface 91 of the back 62 and the surrounding upper surface 92 of the base 64, when the folding seat 60 is configured in the first arrangement. The concavity 88 is specifically shaped to receive the convexity 90. The concavity 88 comprises a generally annular bowl shape with a pair of indents 93 adapted to receive the hinges 61, best shown in FIG. 10. As shown in FIG. 11, this arrangement allows a plurality of folding seats 60 to be stacked on top of one another when they are in the first arrangement.

Figure 10:
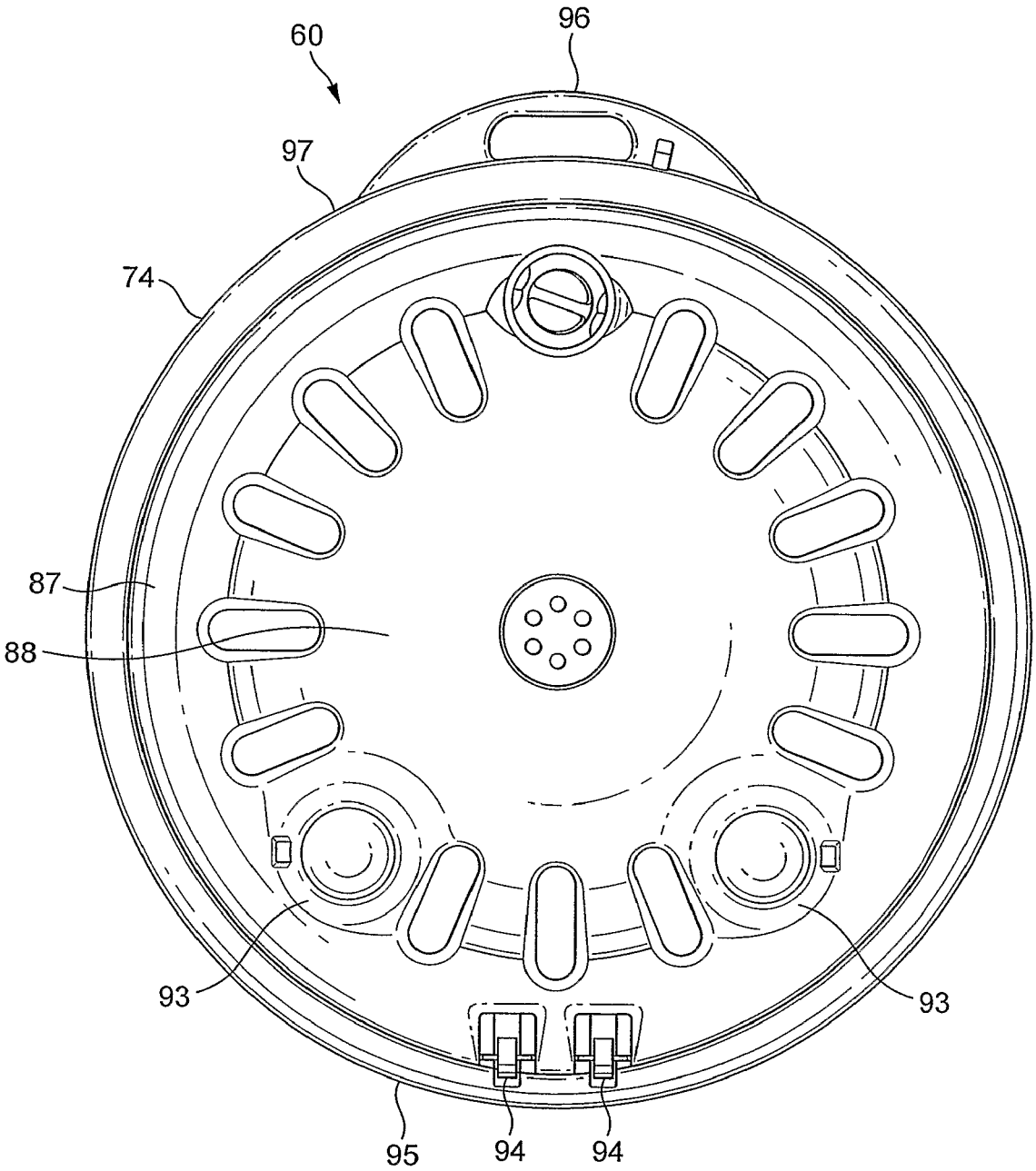
FIG. 10 is a bottom view of the second folding seat shown in FIG. 6.
Figure 11:
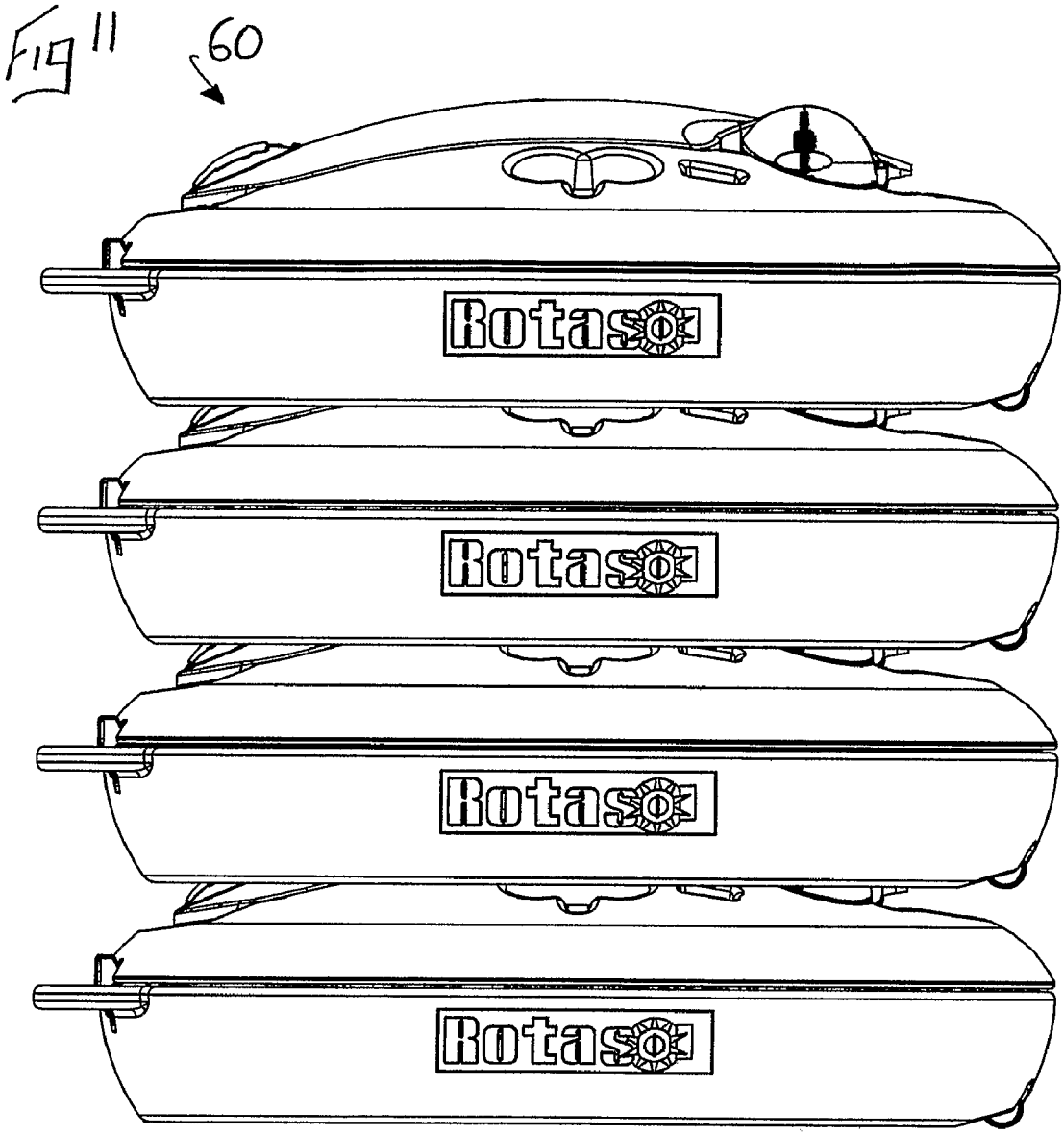
FIG. 11 is a side view of a number of second folding seats like that shown in FIG. 6 arranged in a stack.

FIG. 10 shows the underside 87 of the stationary part 74, and the shape of the concavity 88 is clearly visible. FIG. 10 also shows that the stationary part 74 is provided with a pair of wheels 94 at a first end 95 thereof. The stationary part 74 is also provided with a handle 96 at a second end 97 thereof. As such, a user can use the handle 96 to lift the folding seat 60 onto its wheels 94 for easy transport.

Figure 12:
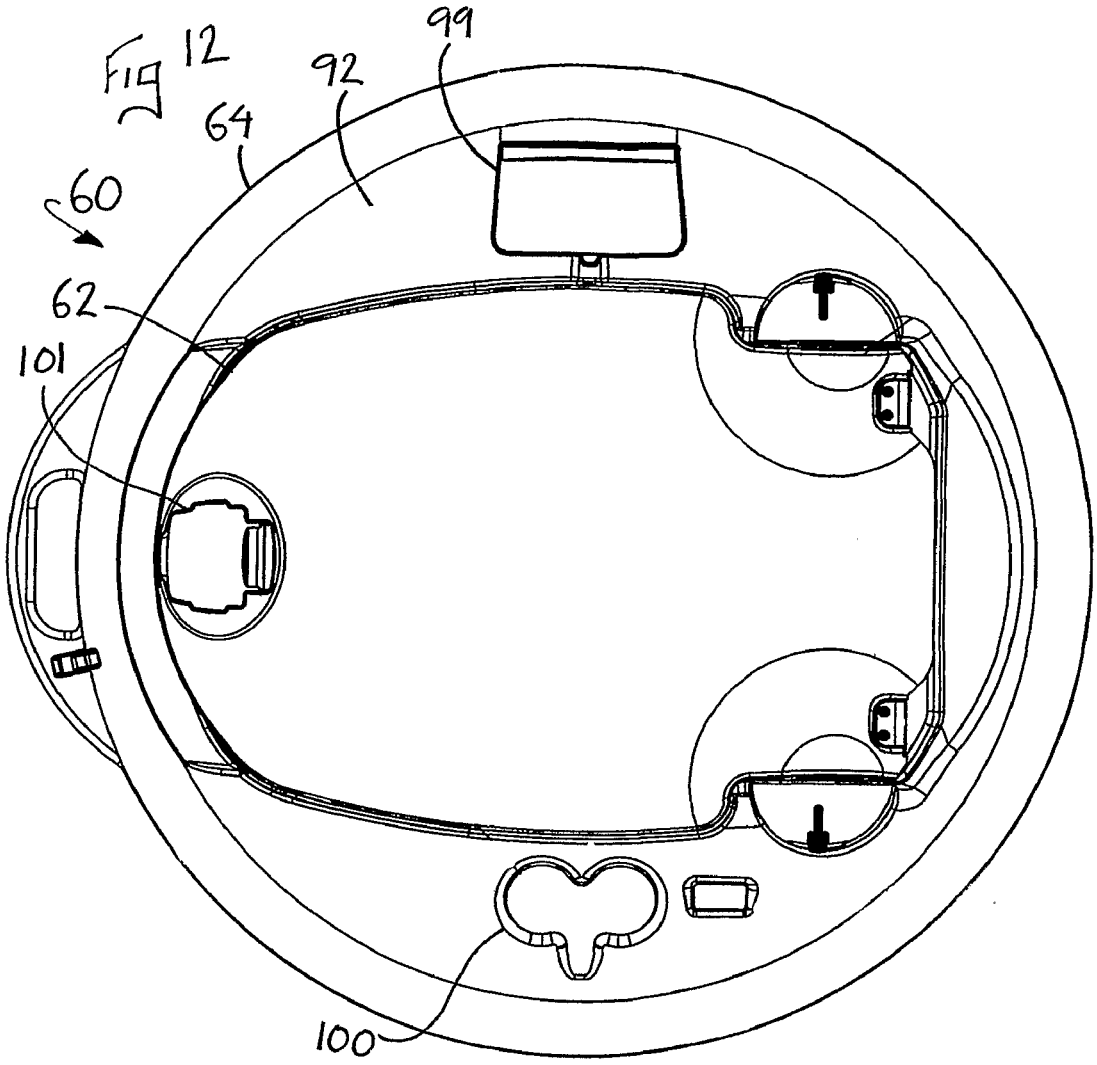
FIG. 12 is a top view of the second folding seat as shown in FIG. 6 in a first arrangement; and, FIG. 13 is a side view of the second folding seat as shown in FIG. 12 in a first arrangement.

The other differences between folding seat 1 and folding seat 60 are that the drain 98 is positioned at the second end 97 of the stationary part 74, and as shown in FIG. 12 the upper surface 92 of the base 64 is provided with storage compartments. A first storage compartment 99 is provided with a lockable lid, while a second storage compartment 100 is adapted to hold drinks containers. As is also clear from FIG. 12, the lock (not visible) which locks the back 62 to the base 64 is provided with a hinged cover flap 101.

The embodiments shown in the Figures can be altered without departing from the scope of claim 1. For example in one alternative embodiment (not shown) the seat is adapted to float on water. No drain is provided, and the base is constructed from materials adapted to float, while supporting the weight of the seat 1 and the user.

In another alternative embodiment (not shown) the inner storage space 5 is not provided due to a different folding seat construction, and the inner storage space essential to the invention comprises the storage compartments 28 and 30.

Thus, a sun lounger is provided which doubles as a secure container for a user's accessories. In addition, a sun lounger is provided which can be readily rotated on the spot to face the sun, and which has a degree of give to add comfort.

The invention claimed is:

1. A folding seat comprising a base, a back and a seat base, in which the back is connected to the base by a first hinge means, in which the base comprises an open topped container defining an inner storage space, in which the back has an outer end and an inner end, in which an axis of rotation of the first hinge means is spaced apart from the inner end, in which the seat base is fitted in the open topped container with a first end thereof being connected to the inner end of the back by a second hinge means, in which in a first arrangement the back is arranged to overlie the open topped container such that a closed container is formed, and in which in a second alternative arrangement the back is arranged at rotational positions in relation to the open topped container such that seating and/or lying platforms are formed, with the seat base forming the seat part of said seating and lying platforms.

2. A folding seat as claimed in claim 1 in which the seat base has a second end opposite to the first end, and in which the base is adapted to position the second end level with or above the first end when the seating or lying platform is formed.

3. A folding seat as claimed in claim 2 in which the base is provided with interior side walls, in which said interior side walls are provided with guide channels, in which the seat base is provided with guide pins located in said guide channels, and in which said guide channels follow an inclined path, such that second end of the seat base is level with or above the first end when the seating or lying platform is formed.

4. A folding seat as claimed in claim 3 in which the first hinge means are provided with locking means adapted to lock the back in one or more positions when the folding seat is arranged in the second arrangement.

5. A folding seat as claimed in claim 4 in which the guide channels are provided with indents adapted to receive the guide pins when the back is locked in said one or more positions.

6. A folding seat as claimed in claim 4 in which the locking means are adapted to lock the back at substantially 107 degrees to the base, at substantially 135 degrees to the base and at substantially 163 degrees to the base.

7. A folding seat as claimed in claim 6 in which the base is provided with support means, and in which the second end of the seat base is supported by said support means in the second arrangement.

8. A folding seat as claimed in claim 4 in which the back is provided with a rear surface, and in which the base is provided with an exterior surface, and in which the rear surface of the back contacts the exterior surface of the base when the back is substantially horizontal.

9. A folding seat as claimed in claim 3 in which the interior side walls are provided with storage compartments.

10. A folding seat as claimed in claim 2 in which an extension part is hinged to the second end of the seat base, which extension part is manually unfoldable from the seat base.

11. A folding seat as claimed in claim 1 in which the base is provided with a drain.

12. A folding seat as claimed in claim 1 in which the base has an upper surface adjacent to the inner storage space, and in which the upper surface is provided with storage compartments.

13. A folding seat as claimed in claim 1 in which the base comprises a stationary part and a rotating part, in which the rotating part comprises said back and seat base.

14. A folding seat as claimed in claim 13 in which annular bearing means are disposed between the stationary part and the rotating part.

15. A folding seat as claimed in claim 14 in which the annular bearing means comprises a race on the stationary part, a race on the rotating part, and balls disposed in said races, and in which said balls are resilient.

16. A folding seat as claimed in claim 14 in which the annular bearing means comprises an inner bearing and an outer bearing both of which comprise an annular arrangements of rollers provided on the stationary part and runner surfaces provided on the rotating part.

17. A folding seat as claimed in claim 14 in which the folding seat is provided with a releasable latch means adapted to prevent the rotating part rotating in relation to the stationary part.

18. A folding seat as claimed in claim 1 in which an underside of the folding seat is provided with a convexity, and in which the convexity is adapted to fit into the concavity, such that the folding seat is stackable with other folding seats.

19. A folding seat as claimed in claim 1 in which the base is provided with wheels.

20. A folding seat as claimed in claim 1 in which said wheels are provided at a first end of the base, and in which the base is provided with a handle at a second end thereof.

21. A folding seat as claimed in claim 1 in which locking means are provided to lock the closed container.

22. A folding seat comprising a base and a back hinged thereto, in which the base comprises an open topped container defining an inner storage space, in which in a first arrangement the back is folded onto the base, and a closed container is formed, and in which in a second arrangement the back is unfolded from the base and a seating or lying platform is formed and in which a seat base is provided by the base, which seat base forms the seat part of said seating or lying platform, wherein the back is connected to the base by hinge means, in which the back has an outer end and an inner end, in which the axis of rotation of the hinge means is spaced apart from the inner end, in which a first end of the seat base is hinged to the inner end of the back, the seat base having a second end opposite to the first end, and in which the base is adapted to position the second end level with or above the first end when the seating or lying platform is formed, the base is provided with interior side walls, in which said interior side walls are provided with guide channels, in which the seat base is provided with guide pins located in said guide channels, and in which said guide channels follow an inclined path, such that second end of the seat base is level with or above the first end when the seating or lying platform is formed.

* * * * *

UNITED STATES PATENT AND TRADEMARK OFFICE

CERTIFICATE OF CORRECTION

PATENT NO. : 8,100,418 B2
APPLICATION NO. : 12/224914
DATED : January 24, 2012
INVENTOR(S) : Steven Watts It is certified that error appears in the above-identified patent and that said Letters Patent is hereby corrected as shown below:

Title page, under (74) Attorney, Agent, or Firm, "Krumbolz" should read --Krumholz--.

In the Specifications

Column 10, line 10, "that second end" should read --that the second end--.

Signed and Sealed this
Thirtieth Day of April, 2013

Teresa Stanek Rea
*Acting Director of the United States Patent and Trademark Office*